United States Patent [19]

Furukawa et al.

[11] 4,219,077

[45] Aug. 26, 1980

[54] MULTITUBULAR HEAT EXCHANGER USED IN A POWER PLANT

[75] Inventors: Masahiro Furukawa, Tokyo; Yoshikuni Ohshima, Hitachi, both of Japan

[73] Assignee: Hitachi, Ltd., Japan

[21] Appl. No.: 909,068

[22] Filed: May 24, 1978

[30] Foreign Application Priority Data

May 27, 1977 [JP] Japan ..... 52/61030

[51] Int. Cl.[2] ..... F28B 9/10; F28F 9/22

[52] U.S. Cl. ..... 165/114; 122/441; 165/161; 165/163

[58] Field of Search ..... 165/114, 160, 161, 163, 165/176; 122/32, 441

[56] References Cited

U.S. PATENT DOCUMENTS

| | | | |
|---|---|---|---|
| 1,764,716 | 6/1930 | Ehrhart | 165/112 |
| 2,180,840 | 11/1939 | Tuley et al. | 165/114 |
| 3,349,841 | 10/1967 | Stoker | 165/114 |
| 3,795,273 | 3/1974 | Brigida et al. | 122/441 |
| 3,938,588 | 2/1976 | Coit et al. | 122/441 |

OTHER PUBLICATIONS

Operational Experience with Heat Exchangers in Nuclear Power Stations with Light Water Reactors, Baschek et al., "Combustion," Sep. 1975, pp. 14–23.

*Primary Examiner*—Sheldon Jay Richter
*Attorney, Agent, or Firm*—Craig & Antonelli

[57] ABSTRACT

A multitubular heat exchanger used in a power plant is provided with a bundle of U-shaped heat transfer tubes and a vent tube. The vent tube is located between an upper portion and a lower portion of the bundle of U-shaped heat transfer tubes. A steam flow guide plate is located above a hole of the vent tube and below the upper portion of the bundle of U-shaped heat transfer tubes. The steam flow guide plate obstruct a downward steam flow from the upper portion of the bundle toward the vent tube.

5 Claims, 8 Drawing Figures

MULTITUBULAR HEAT EXCHANGER USED IN A POWER PLANT

BACKGROUND OF THE INVENTION

This invention relates to a multitubular heat exchanger provided with a bundle of U-shaped heat transfer tubes and a vent tube for collecting noncondensable gas in a shell, especially to a feedwater heater used in thermal and nuclear power plants.

Feedwater heater used in such a power plant is shown in U.S. patent application Ser. No. 823,655 filed in 1977 "MULTITUBULAR HEAT EXCHANGER" in the name of FURUKAWA et al., assigned to the same asignee of the present application. In the above U.S. Patent Application, a shell forms a steam condensing compartment. A bundle of U-shaped heat transfer tubes are located in the steam condensing compartment. A vent tube is located between an upper portion and a lower portion of the bundle of U-shaped tubes. A steam inlet of the steam condensing compartment is formed at an upper portion of the shell.

Feedwater is introduced in the lower portion of the U-shaped tubes and discharged from the upper portion of the U-shaped tubes. Steam is introduced in the steam condensing compartment through the steam inlet formed at the upper portion of the shell. Steam introduced in the steam condensing compartment, at first, heats feedwater flowing through the upper portion of the U-shaped tubes. Secondarily, steam heats feedwater flowing through the lower portion of the U-shaped tubes.

Accordingly, the temperature of feedwater flowing through the upper portion of the U-shaped tubes is higher than that of feedwater flowing through the lower portion. The ratio of the amount of heat exchanged in the lower portion of the bundle of U-shaped tubes to that in the upper portion of the bundle is about 20:1. A greater amount of steam is condensed into water in the lower portion of the bundle while a less amount of steam is condensed in the upper portion of the bundle. So, a greater amount of steam flows into the lower portion of the bundle, especially toward the middle of the lower portion of the bundle.

The steam includes noncondensable gas, for example ammonia gas which is for avoiding an adherance of scale to an interior of a boiler. Ammonia gas stagnates in the middle of the lower portion of the bundle. In this way, a noncondensable gas stagnating zone is formed there. The U-shaped heat transfer tubes wear away gradually by chemical action, especially at portions of the tubes proximate tube support plates.

Since the vent tube is located between the upper portion and the lower portion of the bundle of the U-shaped tubes, it is difficult to collect noncondensable gas in the noncondensable gas stagnating zone.

SUMMARY OF THE INVENTION

An object of the present invention is to provide a multitubular heat exchanger which prevents a corrosion of the U-shaped heat transfer tubes due to the stagnation of noncondensable gas.

Another object of the present invention is to provide a multitubular heat exchanger in which noncondensable gas accumulates in a region between an upper portion and a lower portion of the bundle of the U-shaped heat transfer tubes.

According to the present invention, a multitubular heat exchanger is provided with a steam flow guide plate. The steam flow guide plate is located above the hole of the vent tube and below the upper portion of the bundle of the U-shaped heat transfer tubes. The steam flow guide plate obstructs a downward steam flow from the upper portion of the bundle toward the vent tubes. The steam obstructed by the steam flow guide plate passes by the side of the steam flow guide plate and flows into the lower portion of the bundle of the tubes. The steam flow turns its direction toward the vent tube. Because, a pressure is the lowest in a region near the vent tube. Noncondensable gas included in the steam accumulates in a region near the vent tube. So, the noncondensable gas is easily collected by the vent tube.

DESCRIPTION OF THE PREFERRED EMBODIMENTS

Figure 1:
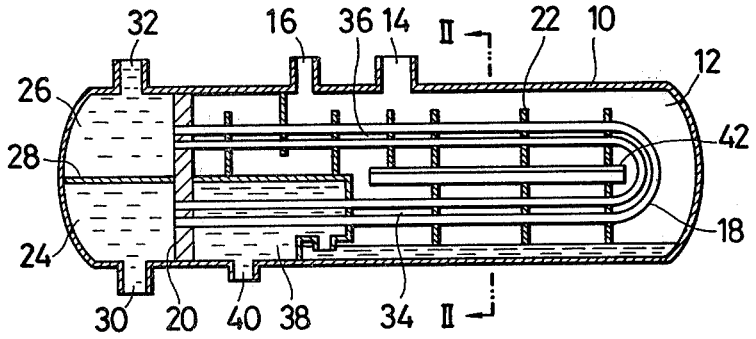
FIG. 1 is a longitudinal sectional view of a feedwater heater of the present invention.
Figure 2:
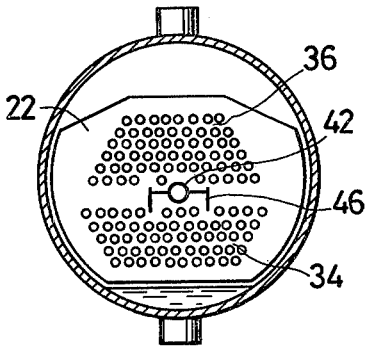
FIG. 2 is a cross sectional view along the line II—II of FIG. 1.

FIG. 1 shows a horizontal-type feedwater heater of the present invention. The heat exchanger is provided with a cylindrical shell 10, a tube plate 20, a bundle of U-shaped heat transfer tubes 18, a vent tube 42, tube support plates 22, a steam flow guide plate 46 and a drain cooler 38.

The shell 10 forms a steam condensing compartment 12. The shell 10 forms a steam inlet 14, at an upper portion of the shell 10, through which steam is introduced from a turbine (not shown) into the steam condensing compartment 12. The shell 10 also forms a drain inlet 16, at an upper portion of the shell 10, through which drain is introduced from a higher pressure feedwater heater (not shown) into the steam condensing compartment 12.

The tube plate 20 separates the steam condensing compartment 12 from water boxes 24 and 26 which are divided by a partition plate 28 therebetween. The water boxes 24 and 26 are for uniformly distributing feedwater into the U-shaped heat transfer tubes 18. The water box 24 is provided with a feedwater inlet 30 through which feedwater to be heated is introduced into the heat exchanger. The water box 28 is provided with a feedwater outlet 32 which conducts the heated feedwater out of the heat exchanger.

The bundle of U-shaped heat transfer tubes 18 are longitudinally located within the steam condensing compartment 12. They are supported at their ends by the tube plate 20 and at their remaining portions by a plurality of tube support plates 22 which are arranged within the steam condensing compartment 12 with predetermined intervals in longitudinal direction of the shell 10. The U-shaped heat transfer tubes 18 communicate the two water boxes 24 and 26.

A drain cooler 38 is located at the feedwater inlet portion of the U-shaped heat transfer tube 18. In the drain cooler 38, feedwater is preheated by the drain. The drain cooler 38 is provided with a drain outlet 40 which conducts the drain out of the heat exchanger.

Figure 3:
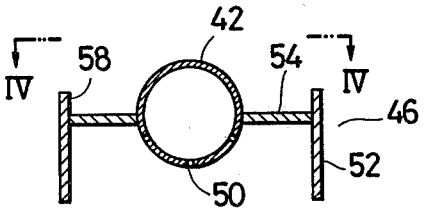
FIG. 3 is a cross sectional view if a vent tube and a steam flow guide plate.

A vent tube 42 is located between an upper portion 36 and a lower portion 34 of the U-shaped heat transfer tubes 18 in longitudinal direction of the shell 10. The vent tube 42 is provided with a plurality of holes 50 as shown in FIG. 3 in axial and radial direction of the vent tube 42. The vent tube 42 collects noncondensable gas through the holes and discharges the collected noncondensable gas outside of the shell 10.

As shown in FIG. 1 to FIG. 4, a steam flow guide plate 46 is located above the holes 50 of the vent tube 42 and below the upper portion 36 of the bundle of the U-shaped heat transfer tubes 18. The steam flow guide plate 46 comprises vertical sections 52 and horizontal sections 54.

The vertical sections 52 are arranged at both sides of the vent tube 42 and between the upper portion 36 and the lower portion 34 of the bundle of the U-shaped heat transfer tubes 18. They are supported by the tube support plates 22. They prevent steam flow between the upper portion 36 and the lower portion 34 of the bundle of the U-shaped heat transfer tubes. The vertical sections 52 extend within the lower portion 34 of the bundle of the U-shaped heat transfer tubes 18 so that steam prevented by the vertical sections 52 is easy to introduce into the lower portion 34 of the bundle.

Figure 4:
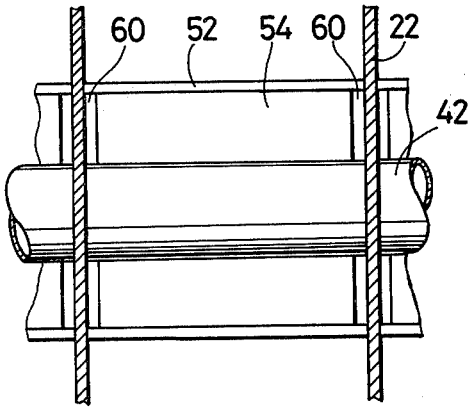
FIG. 4 is a fragmentary sectional view along the line 1v—IV of FIG. 3.

The horizontal section 54 is attached at one longitudinal end to the vent tube 42 and at the other longitudinal end to the upper portion 58 of the vertical section 52. The vertical section 52 projects beyond the horizontal section 54. The ends of horizontal section 54 faces to the tube support plate 22 with a gap 60 as shown in FIG. 4. The gap 60 is adequately small so that drain drops through the gap 60 along the tube support plates 22. The drain washes the portions of the U-shaped heat transfer tubes 18 proximate the tube support plates 22.

The performance of the feedwater heater will now be described. Feedwater in the water box 24 is distributed into the U-shaped heat transfer tubes 18. Extraction steam from a turbine (not shown) is introduced into the steam condensing compartment 12 through the steam inlet 14. The extraction steam heats feedwater flowing through the U-shaped heat transfer tubes 18. The feedwater heated in the heat transfer tubes 18 is introduced into the water box 26 and discharged out of the water box 26 through the feedwater outlet 32.

Figure 5:
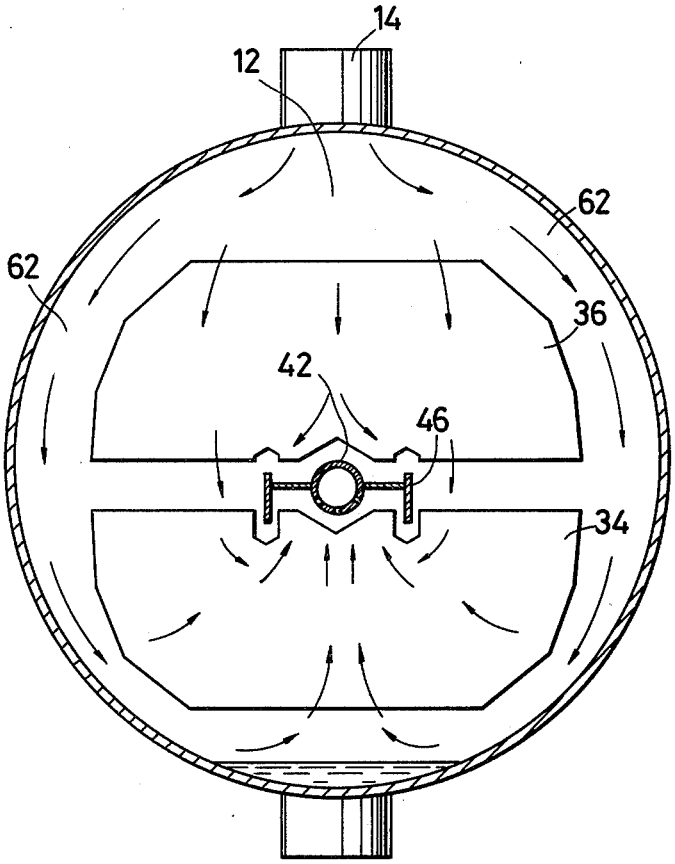
FIG. 5 is an enlarged cross sectional view of FIG. 2 with arrows showing steam flows.

A flow of steam in the steam condensing compartment 12 is shown by arrows in FIG. 5.

A part of extraction steam introduced in the steam condensing compartment 12 through the steam inlet 14 flows downwardly among the upper portion 36 of the U-shaped heat transfer tubes 18 toward the steam flow guide plate 46. The horizontal section 54 of the steam flow guide plate 46 obstructs a flow of the part of steam. The flow of the part of steam obstructed passes by the outside of the vertical section 52 of the steam flow guide plate 46 and flows among the lower portion 34 of the bundle of the tubes 18. The flow of the part of steam turns its direction upwardly toward the vent tube 42. This upward flow comes to the vent tube 42 without obstructed by the downward flow of steam since the horizontal section 54 obstructs the downward flow of steam.

The remaining part of steam flows downwardly through a path 62 between the U-shaped heat transfer tubes 18 and the shell 10 toward the bottom of the shell 10. The flow of the remaining part of steam turns its direction upwardly toward the vent tube 42. This flow also comes to the vent tube 42.

The steam condenses into drain in the steam condensing compartment 12 while the steam heats the feedwater in the heat transfer tubes 18. The drain is introduced in a drain cooler 38. The drain in a drain cooler 38 is cooled by feedwater in the U-shaped heat transfer tubes 18. The cooled drain is discharged out of the feedwater heater through a drain outlet 40.

As mentioned above, according to the steam flow guide plate 46, the whole steam among the lower portion 34 of the U-shaped heat transfer tubes 18 flows toward the vent tube 42. Accordingly, noncondensable gas included in steam is easy to collect by means of the vent tube 42.

Figure 6:
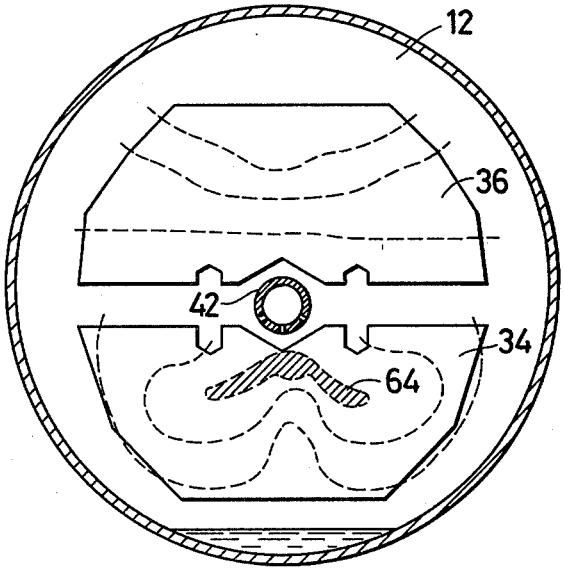
FIG. 6 is a schematic cross sectional view of a feedwater heater showing a pressure gradient and noncondensable gas stagnating zone in a shell where the ratio of the amount of heat exchanged in an upper portion and a lower portion of the bundle of U-shaped heat transfer tubes is 11.1:1 and the feedwater heater is not provided with a steam flow guide plate of the present invention.
Figure 7:
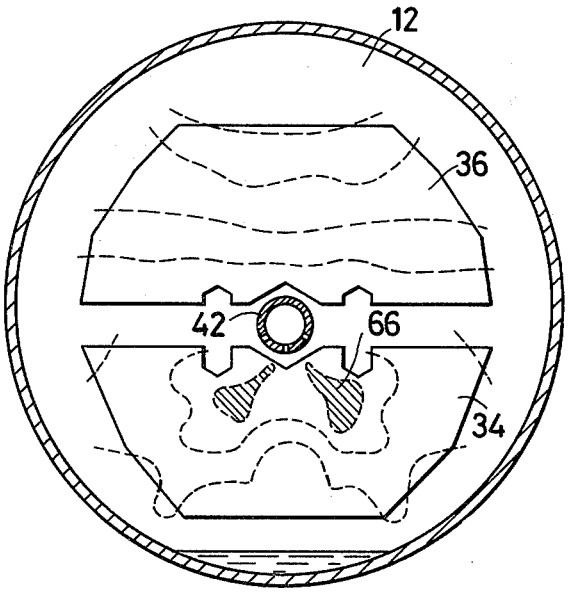
FIG. 7 is a schematic cross sectional view of a feedwater heater showing a pressure gradient and noncondensable gas stagnating zone in a shell where the ratio of amount of heat exchanged in an upper portion and a lower portion of the bundle of the U-shaped heat transfer tubes is 18.6:1 and the feedwater is not provided with a steam flow guide plate of the present invention.
Figure 8:
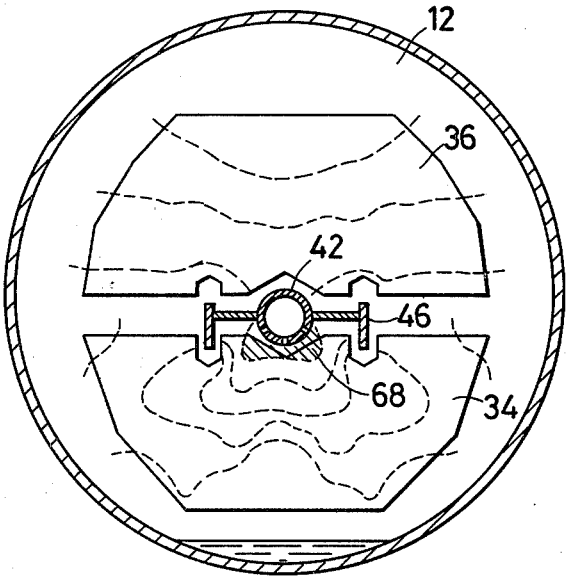
FIG. 8 is a schematic cross sectional view of a feedwater heater showing a pressure gradient and noncondensable gas stagnating zone in a shell where the ratio of amount of heat exchanged in an upper portion and a lower portion of the bundle of U-shaped heat transfer tubes is 28.6:1 and the feedwater heater is provided with a steam flow guide plate of the present invention.

FIG. 6, FIG. 7 and FIG. 8 show effects of the present invention.

In FIG. 6, broken lines means isobaric lines within the steam condensing compartment 12 where the ratio of the amount of heat exchanged in the upper portion 36 and the lower portion 34 of the U-shaped heat transfer tubes 18 is 11.1:1 and the feedwater heater is not provided with a steam flow guide plate of the present invention. A shaded portion 64 enclosed by an isobaric line is a lowest pressure region in the steam condensing compartment 12, that is a steam stagnating zone. Steam including noncondensable gas accumulates in the steam stagnating zone 64. Since the steam stagnating zone 64 is relatively remote from the vent tube 42, noncondensable gas is difficult to such through the holes of the vent tube 42.

FIG. 7 shows iosbaric lines where the ratio of the amount of heat exchanged in two portions 34 and 36 of the bundle of the tubes is 18.6:1 and the feedwater heater is not provided with a steam flow guide plate of the present invention. A steam stagnating zone 66 is further remote from the vent tube 42.

FIG. 8 shows isobaric lines where the ratio of the amount of heat exchanged in two portions 34 and 36 of the bundle of the tubes is 28.6:1 and the feedwater heater is provided with a steam flow guide plate 46 of the present invention. A steam stagnating zone 68 is under the steam flow guide plate 46 and near the vent tube 42. The noncondensable gas included in the steam is easy to such through the holes of the vent tube 42.

What is claimed is:

1. A multitubular heat exchanger used in a power plant comprising:

a shell forming therein a steam condensing compartment and a steam inlet at an upper portion of the steam condensing compartment, a bundle of U-shaped heat transfer tubes located within the steam condensing compartment for heat-exchanging between feedwater flowing therethrough and steam introduced into the steam condensing compartment through the steam inlet, a vent tube located between an upper portion and a lower portion of said bundle of U-shaped heat transfer tubes and arranged in the longitudinal direction of said shell for collecting noncondensable gas through a hole of said vent tube from the steam condensing compartment, a plurality of tube support plates arranged within the steam condensing compartment with predetermined intervals in longitudinal direction of said shell for supporting said bundle of U-shaped heat transfer tubes and said vent tube, and a steam flow guide plate located above the hole of said vent tube and below the upper portion of said bundle of U-shaped heat transfer tubes, said steam flow guide plate obstructing a downward steam flow from the upper portion of said bundle of U-shaped heat transfer tubes toward said vent tube and forming upward steam flow from the lower portion of said bundle of U-shaped heat transfer tubes toward said vent tube, wherein said steam flow guide plate comprises:

a vertical section for preventing steam flow between the upper portion and the lower portion of said bundle of U-shaped heat transfer tubes toward said vent tube, said vertical section being arranged between the upper portion and the lower portion of said bundle of U-shaped heat transfer tubes at both sides of said vent tube and supported by said tube support plates, and a horizontal section for obstructing a downward steam flow from the upper portion of said bundle of U-shaped heat transfer tubes toward said vent tube, said horizontal section being located between said vertical sections and supported by said vertical section.

2. The multitubular heat exchanger set forth in claim 1, wherein said steam flow guide plate attached to said vent tube.

3. The multitubular heat exchanger set forth in claim 2, wherein ends of said horizontal section face to said tube support plate with a gap.

4. The multitubular heat exchanger set forth in claim 3, wherein one end of said vertical section of said steam flow guide plate projects beyond said horizontal section of said steam flow guide plate.

5. The multitubular heat exchanger set forth in claim 4, wherein the other end of said vertical section of said steam flow guide plate extends within the lower portion of said bundle of U-shaped heat transfer tubes.

* * * * *